US008052150B2

(12) United States Patent
Polodna

(10) Patent No.: US 8,052,150 B2
(45) Date of Patent: Nov. 8, 2011

(54) TEXTURE GAME

(76) Inventor: Susan Polodna, Naples, FL (US)

( * ) Notice: Subject to any disclaimer, the term of this patent is extended or adjusted under 35 U.S.C. 154(b) by 31 days.

(21) Appl. No.: 12/082,738

(22) Filed: Apr. 14, 2008

(65) Prior Publication Data

US 2009/0256312 A1 Oct. 15, 2009

(51) Int. Cl.
*A63F 3/00* (2006.01)

(52) U.S. Cl. ..... 273/288; 273/440; 434/259

(58) Field of Classification Search ..... 273/440, 273/459, 139, 144 R, 150, 288; 434/258, 434/259; 383/41–61.2; 373/41–44, 46–54, 373/59–61; 220/229

See application file for complete search history.

(56) References Cited

U.S. PATENT DOCUMENTS

| | | | | | |
|---|---|---|---|---|---|
| 2,751,952 | A * | 6/1956 | Mirus | 383/41 |
| 3,116,927 | A * | 1/1964 | Kuhlman | 273/272 |
| 3,484,105 | A * | 12/1969 | Winston | 273/440 |
| 4,328,904 | A * | 5/1982 | Iverson | 220/229 |
| 4,685,672 | A * | 8/1987 | Fillers | 273/459 |
| 4,840,374 | A * | 6/1989 | Skinner | 273/440 |
| 5,529,311 | A * | 6/1996 | Johnson | 273/440 |
| 5,988,468 | A * | 11/1999 | Murdoch et al. | 224/237 |
| 6,609,715 | B2 * | 8/2003 | Anthony | 273/447 |
| 6,986,433 | B2 * | 1/2006 | Colford et al. | 220/229 |
| 7,347,421 | B2 * | 3/2008 | Ibach | 273/260 |

* cited by examiner

*Primary Examiner* — Vishu K. Mendiratta
(74) *Attorney, Agent, or Firm* — Ronald C. Capossela

(57) ABSTRACT

The Texture Game 1 is provided for determining the texture of a pair of game pieces 5 that are enclosed in a cylindrical enclosure 2 with open ends, a fabric 3 covers the enclosure 2 and overlaps the open ends, and elastic means 4 sewn into the ends of the fabric substantially closing the open ends but allows a players hand to be inserted into the enclosure 2 for determining the texture of the pairs of game pieces 5 and for withdrawing the matching game pieces from within the enclosure 2.

3 Claims, 2 Drawing Sheets

TEXTURE GAME

CROSS REFERENCE TO RELATED APPLICATIONS

None

FEDERALLY SPONSORED RESEARCH

None

SEQUENCE LISTING

None

BACKGROUND OF THE INVENTION

This invention relates to a game for teaching students to develop focus, concentration and perseverance through their sense of touch. This invention is ideal for teaching art students to use their sense of touch to determine the difference in the texture of game pieces made of different fabric.

SUMMARY OF THE INVENTION

My invention solves a long standing problem in teaching which provides for an exercise for art students to determine the difference in texture among items that they may draw, sculpt or model. The major problem in teaching these concepts is for the students to feel the object without seeing the object.

An advantage of my invention is that with repeated play a student will improve his/her tactile identifying abilities.

Another advantage of my invention is that a student is playing a game and is on an equal footing with an adult.

Another advantage of my invention is that it can increase social skills for a student who may be withdrawn.

Another advantage of my invention is that it can be played independently or in a group.

Another advantage of my invention is that it is compact and mobile and can be easily moved from place to place.

Another advantage of my invention is that it can be used by a person lacking sight to improve his/her ability to determine texture of materials by touch.

Another advantage of my invention is its use in occupation therapy for improving a person's motor skills.

The advantages of my invention will become apparent from the study of the following description and the accompanying drawings. It should be understood that variations may be made in the details and general features of the design concept without departing from the spirit and scope of the invention. For example the design of the present invention could be made as a triangle, rectangle, pentagon, hexagon, octagon or any other multisided enclosure. The fabric used could be any material easily available at any fabric shop. The game pieces could be made in any shape without departing from the scope of the invention.

DETAILED DESCRIPTION OF THE PREFERRED EMBODIMENT

Figure 1A:
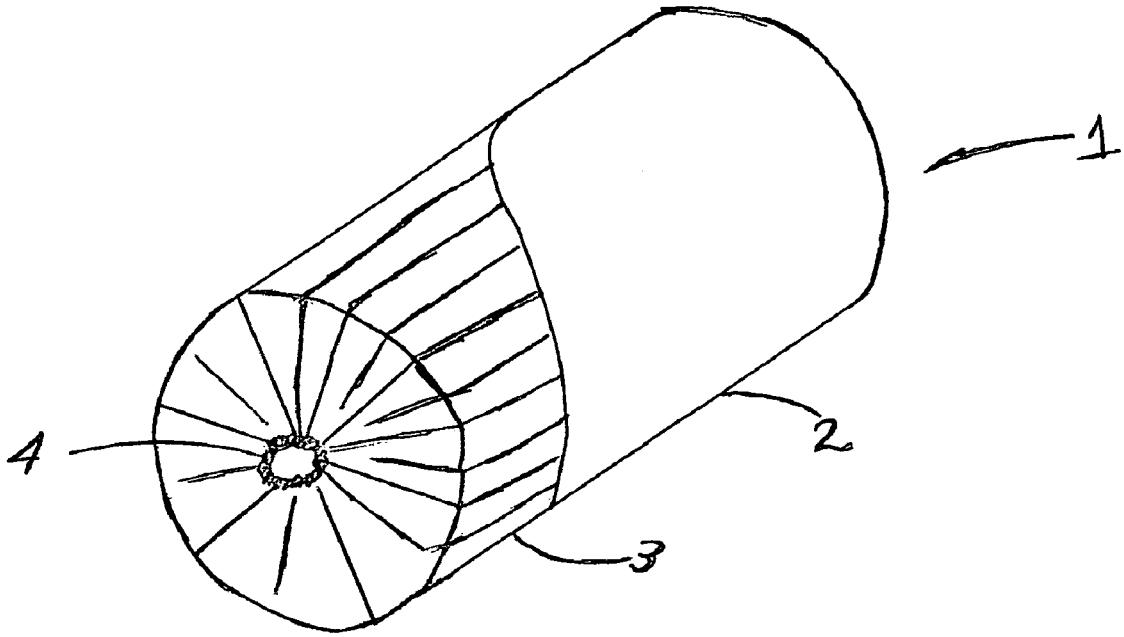
FIG. 1A is perspective view of the game enclosure of the preferred embodiment.

FIG. 1A is a perspective and partial cut away view of The Texture Game 1 of the present invention. Cylindrical enclosure 2 is covered with material fabric 3 which overlaps the open ends of the cylindrical enclosure with an elastic means 4 for substantially closing the open ends of the cylindrical enclosure 2.

Figure 1B:
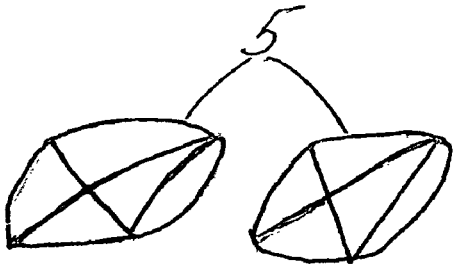
FIG. 1B is a view of a distinct pair of game pieces having the same texture and feel.

FIG. 1B is a view of a distinct pair of game pieces 5 which are one of a plurality of distinct pairs of game pieces located within the cylindrical enclosure 2.

Figure 2:
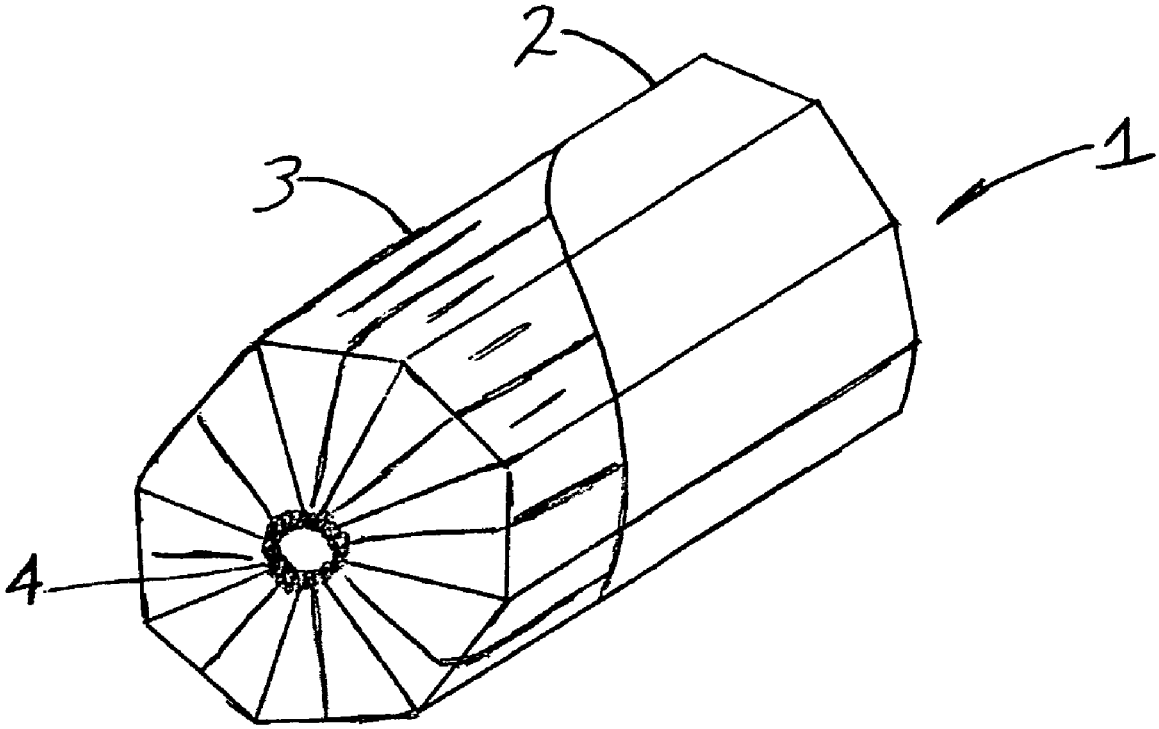
FIG. 2 is a perspective view of an alternative embodiment of the present invention wherein the game enclosure is formed as a multisided enclosure.

FIG. 2 is a perspective view of The Texture Game showing an alternative embodiment of the present invention. Multisided enclosure 2 is covered with fabric material 3 which overlaps the open ends thereof. The edges of the fabric material are gathered with an elastic means 4 sewn around the edges for substantially closing the open ends of the enclosure 2.

NUMERALS

1 The Texture Game
2 enclosure
3 fabric covering
4 elastic means
5 a pair of game pieces having the same texture Operation A plurality of distinct pairs of game pieces are provided within the enclosure which makes up The Texture Game. Each pair of game pieces is constructed as hand sized pillow like elements. Each pair is made from the same fabric and has the same texture. Other pairs of game pieces are made of a different fabric and therefore have different texture. The ideal number of distinct pairs of game pieces is four but any number of distinct pairs could be used. An independent game piece is also provided and made of a material and texture different from any of the other game pieces in the enclosure. This adds to the difficulty of the game because it does not have any matching partner. The approximate diameter of the ends is ten inches and the length of the enclosure is approximately ten inches. The pillow like game pieces are approximately two and a half inches on each side. Although these dimensions are optimal for playing The Texture Game, it is understood by those having ordinary skill in the art that any size could be used and that the present invention is not limited to any specific dimensions.

In playing The Texture Game a player inserts each hand into the enclosure from each side thereof and feels the game pieces until the player picks two game pieces of the same texture. If the player is incorrect the player may try again or the game passes to the next player. A timer could be used to see which player determines the matching pairs the fastest.

The invention claimed is:

1. a game for determining the texture of matching game pieces comprising: a cylindrical enclosure having an outer surface and having open ends, a fabric material sized to cover the outer surface of said cylindrical enclosure and overlap said open ends and having edges, elastic means positioned about the edges of said fabric material for substantially closing said open ends and a plurality of distinct pairs of matching game pieces randomly positioned within said cylindrical enclosure, said plurality of distinct pairs of matching game pieces comprising a first distinct pair of matching game pieces being made from a first material and having a corresponding first texture, and at least a second distinct pair of matching game pieces being made from a second material and having a corresponding second texture such that a person playing the game inserts both hands into the cylindrical enclosure from opposite ends thereof and feels and removes one of said plurality of distinct pairs of matching game pieces from said cylindrical enclosure.

2. the game as set forth in claim 1, further including at least one independent game piece made from an independent material and having a corresponding independent texture randomly positioned within the cylindrical enclosure.

3. the game as set forth in claim 2, wherein each distinct pair of matching games pieces and said at least one independent game piece are pillow shaped and sized to fit comfortably in a player's hand.

* * * * *